United States Patent [19]

Smith

[11] Patent Number: 4,534,132

[45] Date of Patent: Aug. 13, 1985

[54] SPRING ASSISTED DOORS FOR SIDEWALK, PIT AND FLOOR OPENINGS

[75] Inventor: Russell D. Smith, Hacienda Heights, Calif.

[73] Assignee: Red Plastic Co., Inc., Cudahy, Calif.

[21] Appl. No.: 524,547

[22] Filed: Aug. 19, 1983

[51] Int. Cl.[3] ..... E05F 1/10

[52] U.S. Cl. ..... 49/386; 49/367; 404/25

[58] Field of Search ..... 49/386, 33, 367, 369, 49/346; 404/4, 25; 52/19, 21

[56] References Cited

U.S. PATENT DOCUMENTS

| | | | |
|---|---|---|---|
| 736,714 | 8/1903 | Gendron | 404/25 X |
| 879,200 | 2/1908 | Schrader | 49/367 |
| 1,801,840 | 4/1931 | Banfield | 49/386 X |
| 1,837,916 | 12/1931 | Michelman | 49/33 X |

*Primary Examiner*—Kenneth Downey

*Attorney, Agent, or Firm*—Wm. Jacquet Gribble

[57] ABSTRACT

A rectangular frame set into the concrete surround at the head of a shaft supports one or more slab doors that are hinged to the frame. Adjacent each hinge line brackets fixed to the frame support a fixed spindle upon which a helical spring is secured. The spring has an extending limb at one end that bears against the under surface of the door. The other end of the spring is engaged with a winding bushing rotatable on the fixed spindle, and the bushing has a hollow hub for accepting a detachable winder so that the spring may be pre-torqued to the proper loading to raise the door from its horizontal closed position to a substantially vertical attitude for access to the shaft or other opening.

The frame defines a drip trough to collect moisture passing the door edges and when two doors are used a channel extending along the butt line of the doors collects water passing between the adjacent edges of the doors. Safety stops and externally accessible latch handles may be combined with the doors which may have stiffeners fixed to their sides.

9 Claims, 6 Drawing Figures

SPRING ASSISTED DOORS FOR SIDEWALK, PIT AND FLOOR OPENINGS

BACKGROUND OF THE INVENTION

Previously vertically swinging doors for sidewalk, pit and floor openings have been operated by brute strength, elevator cars with cradle tops or by hydraulic cylinders. The first mode is dangerous to personnel and slow, the second does not apply when the shaft is for access only and has no elevator car. Hydraulic lifts are efficient and powerful but they are a maintenance burden and relatively expensive to install. The present invention obviates the need of other types of door motivators by providing means for repeated lifting of vertically swinging doors which may be precisely loaded for the particular door, last indefinitely and need no maintenance apart from the usual lubricating of door hinges. In addition, the door frame may incorporate moisture collectors and simplified latching wherein the central collector is a part of the latching assembly.

BRIEF STATEMENT OF THE INVENTION

The invention contemplates a closure for a vertically opening shaft or opening which adapts to single or double door installations across a shaft head with a surrounding support collar and comprises a frame secured in the collar at the shaft head, the frame being comprised of a substantially U-shaped in crosssection frame member shaped into an open rectangle whose walls define a drip trough and support a fixed spindle upon which a spring door motivator is secured. Means are provided to pre-load the spring so that an extending spring limb bears upon the door with sufficient force to urge the door or doors from closed, horizontal position to substantially vertical open position. A drip channel beneath the abutment line of a pair of doors combines with a parallel latch assembly fixed to one door of a pair to preclude movement upwardly of the second door until the door supporting the latch assembly is raised. When a door is raised, safety stops pivotably secured to opposed edges of each door preclude descent of a door until the stops are folded out of contact with the frame.

The door closure of the invention is adaptable to a large range of door sizes and weights, is easy to operate and to fabricate and handles moisture problems. These and other advantages of the invention are apparent from the following detailed description and drawing.

BRIEF DESCRIPTION OF THE DRAWING

In the various Figures like parts are identified by like numbers.

DESCRIPTION OF THE PREFERRED EMBODIMENTS

Figures 1, 2, 3:
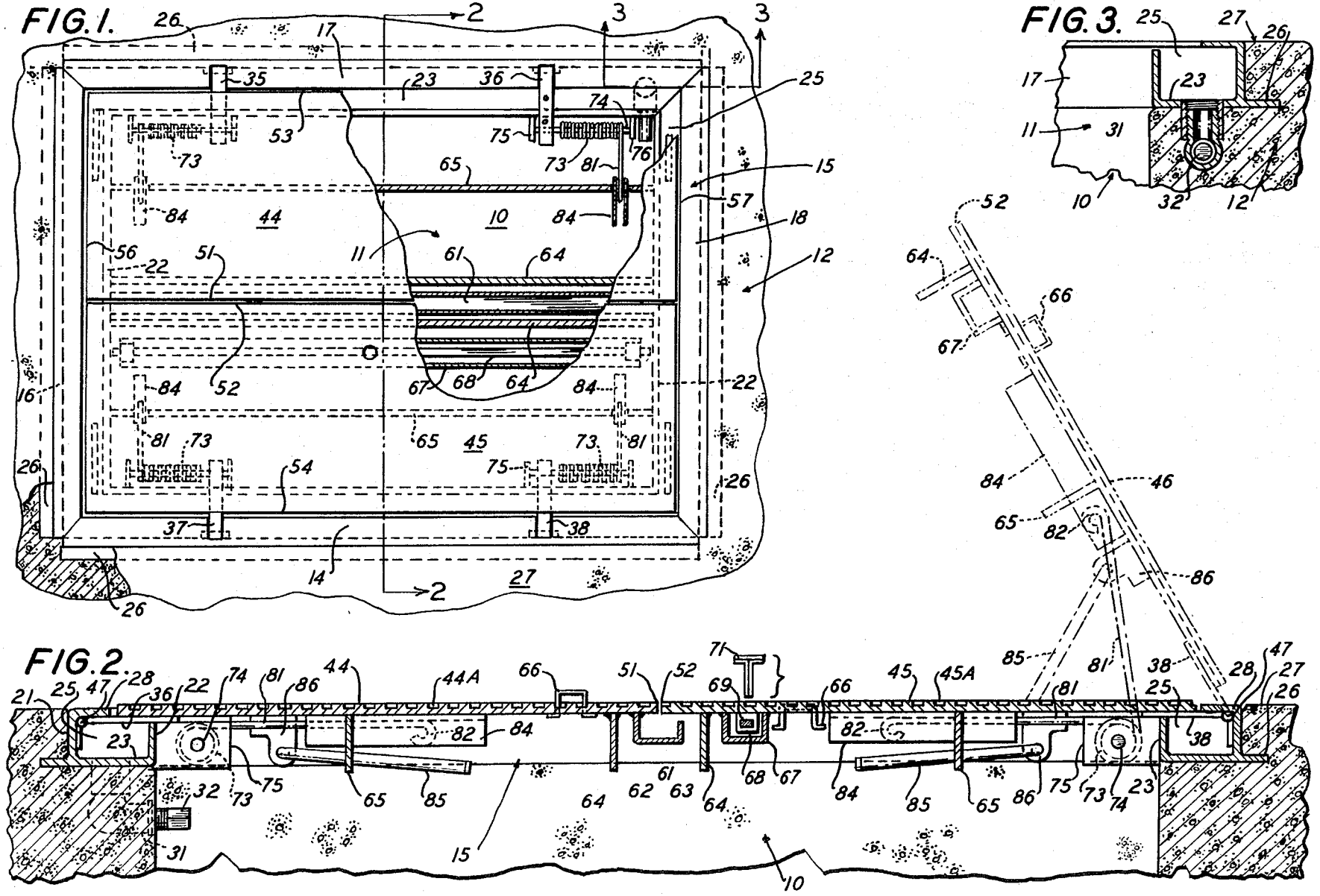
FIG. 1 is a top plan view, partly broken away, of a preferred embodiment of the invention in place at a shaft head.
FIG. 2 is a fragmentary sectional elevational view taken along line 2—2 of FIG. 1.
FIG. 3 is a fragmentary sectional elevational view taken along line 3—3 of FIG. 1 showing a water drain for the door frame.

In FIGS. 1 through 3 an access shaft, which may be for a sidewalk elevator or other pit, or for a floor opening, is generally designated as 10, and has an opening defined by four walls of a shaft head 12. The shaft head may be of poured concrete. A door frame 15 has four sides 16, 17, 18 and 19, each comprised of a U-shaped section having a vertical outer wall 21 spaced transversely from a parallel inner wall 22. A bottom wall 23 connects between the inner and outer walls to define a trough 25, the bottom wall 23 extending outwardly beyond outer wall 21 to form an anchor flange 26 imbedded in a support collar 27 that surrounds the shaft head 12. From outer wall 21 of each side an upper lip 28 extends above the trough to define a border around the trough on all four sides of frame 15.

In order to drain moisture that may collect in the trough an outlet assembly 31 is cast into the wall of the shaft head, as shown in FIGS. 2 and 3. The outlet is threaded to take a removable plug 32 whose inner end 33 is visible in FIG. 3. Conventional pipe components may be used to make up the drain outlet, which in the case of a trough width of $3\frac{1}{2}$ inches, may be of $1\frac{1}{2}$ inch pipe fittings. The frame may be vertically skewed or canted so that the rest of the trough slopes downwardly slightly toward drain outlet assembly 31.

In FIGS. 1 and 2 the frame sides 17 and 19 are seen to accommodate door hinge pairs 35, 36 and 37, 38 respectively. A butt of each hinge is bolted or otherwise secured to an outer wall 21 in vertical alignment and a leaf 42 of each hinge is secured to the under side of one of a matching pair of plate aluminum doors 44, 45. The doors are preferably of an embossed diamond pattern upper surface to aid worker footing. A hinge pin 47 of each hinge is parallel to a frame side 17 or 19. Door inner edges 51, 52 extend in substantial abutment the width of opening 11 and door outer edges 53, 54 are adjacent the inwardly extending horizontal lips 28 of the frame sides. Both doors have opposite side edges 56, 57 parallel respectively to an edge of upper lip 28 of sides 16 and 17 of the frame such that both doors partially overlie trough 23 defined by the vertical frame side walls.

A drip channel 61 shown in FIGS. 1 and 2 has a vertical tall wall 62 and a vertical parallel short wall 63 and extends along the abutting inner edges 51, 52 of the doors. Tall wall 62 is fixed to the under side of door 51 in conventional fashion as by brazing or welding. Adjacent each side of the drip channel is an inner brace or stiffener 64 fixed to the underside of each door. Intermediate the stiffeners 64 and the hinges is a secondary stiffener 65 on each door lower surface. The invention contemplates use of stiffeners other than the strip steel of FIGS. 1 and 2 as is evident from FIG. 4.

FIG. 2 shows a conventional lift handle 66 attached to door 44 and to door 45 near the abutting edges of the two doors, arranged to recess within the interstices of the diamond embossed top of each door so that the handles need not protrude above the top when not in use. Conventionally, door 45 has a latch channel 67 extending transversely of the door near its inner edge 52, but inward of the stiffener 64. Guide brackets such as bracket 68 in FIG. 2 support a latch rod 69 that extends the length of channel 67 and may be actuated by a square-bodied key 71 to engage the rod in conventional fashion in apertures (not shown) in side walls 22 of the frame.

In order to motivate the upward swing of each door when unlatched, helically wound motivator springs 73 are mounted at each of the outer corners of each door. In FIGS. 1 and 2 each motivator spring 73 is supported on a fixed horizontal spindle 74 extending parallel to the line of hinge pins 47, between spindle brackets 75, 76. The brackets in turn are secured to inner vertical walls 22 of frame 15.

Each motivator spring 73 has an extending free limb 81 at an end of the motivator spring remote from bracket 75 and adjacent to bracket 76. The limb has a looped end 82 that bears against the under side of the door in an upward thrust. To prevent abrasion of the door surface by the hard steel spring a guide channel 84 fixed to the bottom of the door receives the looped end. The channel also contains the limb end against possible random motion as the motivator spring urges the door upwardly into open, substantially vertical, attitude as illustrated by the broken lines at 46 in FIG. 2.

In that Figure lift handle 66 is extended above the door outer surface and door safety stop 85 rests upon bottom wall 23 of the frame trough, swinging from its pivot mount in block 86 of the door. Companion door 44 is then free to be lifted as short wall 63 of drip channel 61 is clear of the overhanging edge 52 of door 45.

The sequence of opening the doors is then clear-door lift handle 66 of door 45 is raised and door 45 rises as force is exerted upon it both by the worker and by motivator springs 73. As soon as short wall 63 of door 44 is clear of door inner edge 52, first door 44 is free to be raised, manually and by motivator springs 73, swinging about hinge pins 47 of hinges 35, 36.

Figure 4:
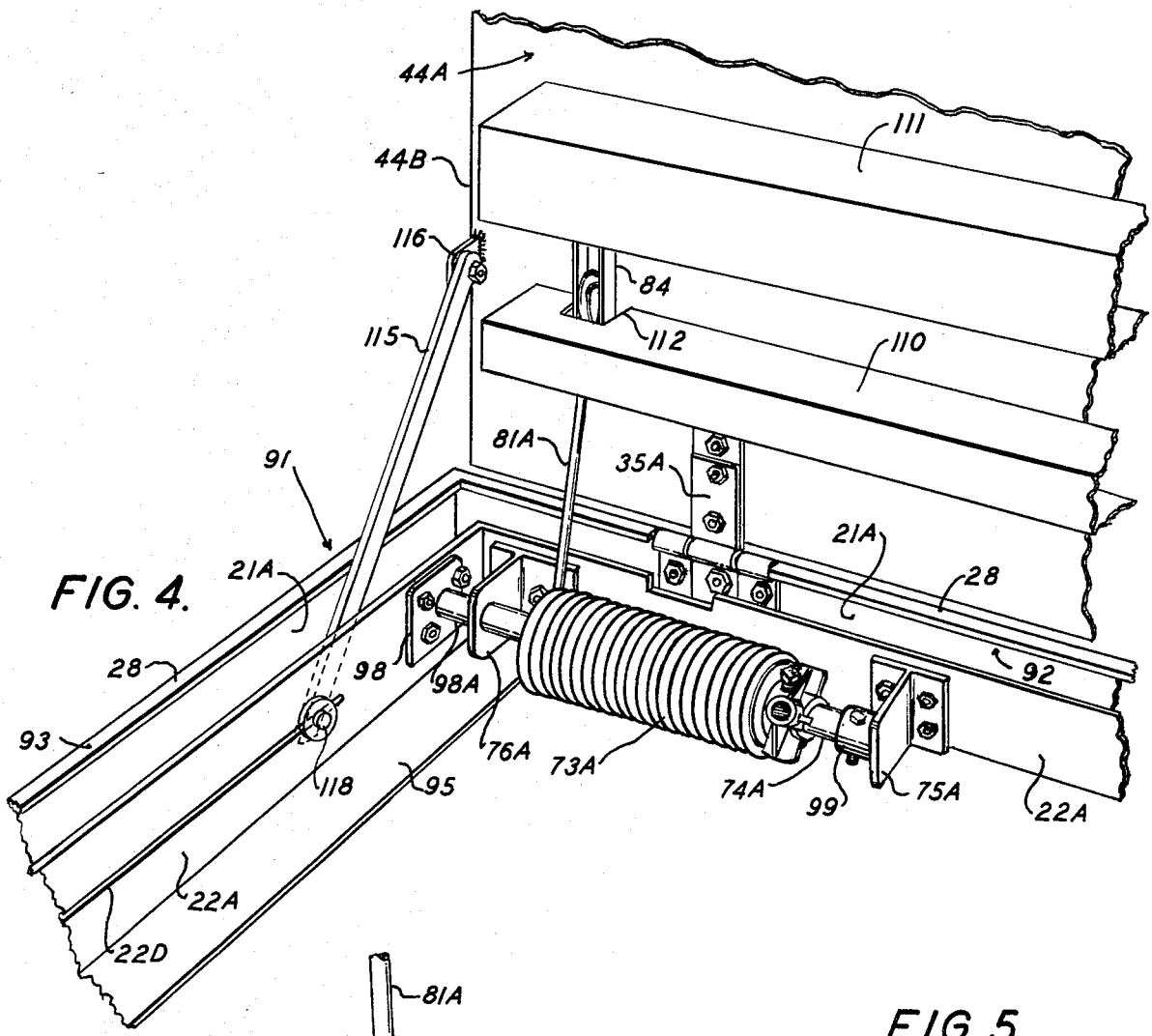
FIG. 4 is a fragmentary perspective view of an alternate embodiment of the invention showing the spring motivator for upward motion of the doors.
Figure 5:
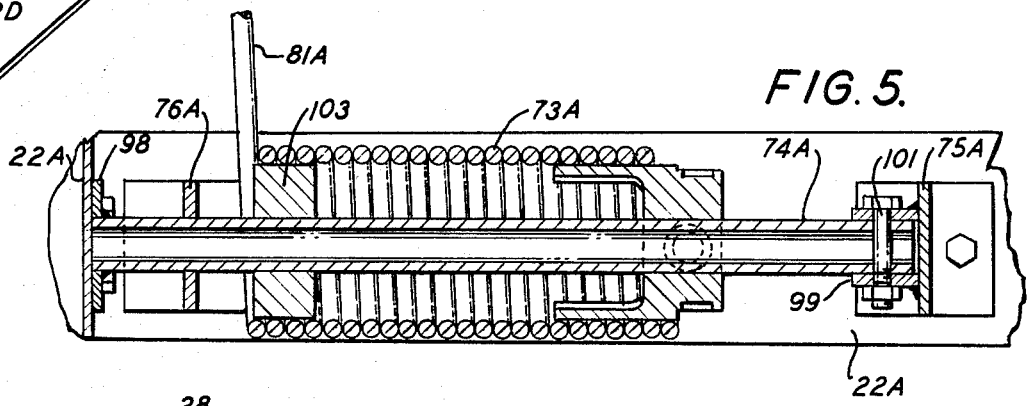
FIG. 5 is a fragmentary sectional elevational view of the spring motivator assembly of FIG. 4 that is typical of both embodiments.
Figure 6:
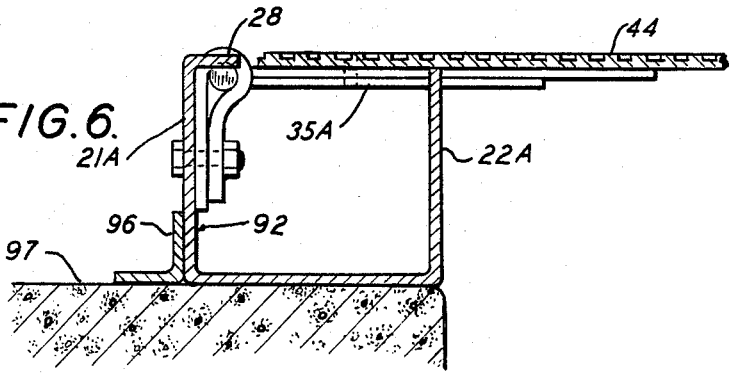
FIG. 6 is a fragmentary sectional elevational view of the hinge and frame combination of an alternate embodiment.

The mode of pre-loading the motivator springs is best explained with respect to FIGS. 4 through 6 wherein an alternate embodiment of the invention is shown with doors 44A and 45A which may be of steel rather than of aluminum, but utilizing the same type of motivator springs as does the embodiment of FIG. 1. A door frame 91 similar in most respects to the frame 15 of FIG. 1 has a hinge side 92 and a safety stop side 93. The sides are typical of the other sides of the frame and the hinge side configuration is best shown in FIG. 6. Both the hinge side and the safety stop side have an upper lip 28 and outer and inner walls 21A and 22A, respectively, and a bottom wall 23, like the previously described embodiment. In addition the safety stop side has an inwardly projecting skirt 95 for stability of the heavier door pair. Instead of an integral peripheral flange, frame 91 has a welded steel angle 96 about the entire frame, so that it may set upon a floor 97, as shown in FIG. 6, or be anchored in a poured surround collar as shown in FIG. 1. Suitable drain fixtures, although not shown, may be provided.

A fixed spindle 74A is mounted between spindle brackets 75A, 76A that are secured to frame wall 22A. In consideration of the greater weight of steel doors, or doors of greater size, a third support bracket 98 fixed to side 93 near the frame corner supports a spindle extension 98A. A bracket hub 99 integral with bracket 75A receives an opposite spindle end 99A and a bolt 101 through both anchors the spindle with respect to the bracket and therefore the frame. As is obvious from FIG. 5, a sleeve 103 on an intermediate portion of spindle 74A supports one end of motivator spring 73A which surrounds the spindle. Like its counter part spring 73 in the embodiment of FIG. 1, spring 73A has a limb 81A which bears against the under side of the door, contacting the web of a guide channel 84 to exert an upward force on the door, without abrasive wear on the door.

A winding bushing 105 is mounted upon the spindle and friction prongs 106 of the bushing extend into the spring in contact with the inner periphery of the spring to grip it tightly. A hub of the bushing outside the spring helix has a binding screw 107 in contact with the spindle to hold the bushing and the spring at a fixed load level once a manipulating or adjusting bar has been placed in a recess 109 of the bushing hub and the movtivator spring twisted about the spindle and secured by screw 107 at the desired torque.

A similar assembly is employed to torque the motivator springs of the embodiment of FIG. 1, although the spindle mounting of the FIG. 1 embodiment need not be as structurally rigid as that of the FIG. 4 embodiment with its steel doors. In that connection, it has been found that $\frac{1}{4}''$ thick aluminum in the size range of $4' \times 6'$ may use a 2" diameter spring helix of 11/32" diameter wire size while the steel doors of comparable size employ a $2\frac{5}{8}$ diameter spring of 13/32" diameter wire. In each case a spring length of 8" has proved satisfactory when combined with a limb length of about 14".

Also, because of the added weight of the steel doors of the second embodiment, it is desirable to use channel stiffeners like the stiffeners 110, 111 of FIG. 4 in place of strip stiffeners 64,65 of the first described embodiment. Such channel stiffeners are also used when the door width exceeds 5 feet, even though the door thickness does not exceed $\frac{1}{4}''$. Stiffener 110 is notched at 112 to fit about limb 85 and guide channel 84.

As previously shown, door safety stops are employed in the FIG. 4 embodiment. A stop 115, which is typical, is pivotably secured at one end to a tab 116 fixed to door edge 44B and an opposite stop end 117 is bolted in slot 22D of inner wall 22A of side 91. Bolt and nut assembly 118 may be adjusted to provide the required snug slip fit.

While only two embodiments of the sidewalk, pit and floor spring assisted doors have been shown, other embodiments within the scope of the invention will occur to those skilled in this art. It is therefore desired that the invention be measured by the appended claims to invention rather than by the illustrative devices shown and described herein.

I claim:

1. In a horizontal door assembly in which doors swing open upwardly urged by adjustable springs to give access to a vertical shaft the combination comprising a shaft head, said shaft head having a surrounding support collar, a frame secured in the support collar, a pair of doors extending horizontally across said frame in closed position, hinges having horizontal pivot pins securing an edge of each door to said frame, a fixed spindle mounted to said frame adjacent an outer edge of each door parallel to the pivot pins of said hinges, a winding bushing rotatable on said spindle, means on said bushing for receiving an adjusting bar, a helical spring supported on said spindle and secured to said winding bushing for rotation thereby to adjust the torque load of said helical spring, a spring limb extending from an end of said helical spring remote from said winding bushing, a spring limb end bearing against each door so as to exert a lift force thereon, and means for securing each winding bushing with respect to a fixed spindle.

2. In a horizontal door assembly in which a door swings open upwardly urged by adjustable springs to give access to a vertical shaft the combination comprising a shaft head, said shaft head having a surrounding support collar, a frame secured in the surrounding support collar, a door extending horizontally across said frame in closed position, door hinges having horizontal pivot pins movably securing an edge of said door to said frame, transversely spaced outer and inner walls on each side of said frame, a bottom wall connecting between said outer and inner walls, a drip trough defined by said outer, inner and bottom walls, a fixed spindle mounted to at least one of said frame inner walls parallel to the pivot pins of said hinges, a sleeve on said spindle, a winding bushing rotatable on said spindle, bushing rotating means on said winding bushing, a helical spring supported on said sleeve and secured to said winding bushing for rotation thereby to pre-load said helical spring, a spring limb extending from an end of said helical spring remote from said winding bushing, a spring limb end bearing against said door so as to exert a lift force thereon, and means for securing said winding bushing with respect to said fixed spindle.

3. A door assembly in accordance with claim 2 further comprising means for latching said door in a horizontal closed position.

4. A door assembly in accordance with claim 3 further comprising manual means for manipulating said latching means from outside said door.

5. A door assembly in accordance with claim 2 further comprising reinforcing members fixed to the underside of said door.

6. A door assembly in accordance with claim 2 wherein said frame comprises outer, inner and bottom walls defining a trough U-shaped in crosssection, a lip extending from said outer wall, a horizontal slot in opposed inner walls, a door brace secured movably in each slot and pivotably secured at its other end to said door adjacent a door edge.

7. A door assembly in accordance with claim 6 wherein said trough further comprises a peripheral horizontal flange adapted to be fixed in the support surface surrounding said shaft.

8. A door assembly in accordance with claim 7 wherein said flange comprises a horizontal extension of said bottom wall of said trough of said frame.

9. A door assembly in accordance with claim 7 wherein said flange comprises angle iron fixed to the outer wall of said trough.

* * * * *